US005327958A

United States Patent [19]

Machata et al.

[11] Patent Number: 5,327,958

[45] Date of Patent: Jul. 12, 1994

[54] STACKED-PLATE HEAT EXCHANGER

[75] Inventors: Vaclav Machata, Hlinsko; Karel Hubacek; Edmund Neubauer, both of Chotebor; Karel Tvrdy, Havl. Brod.; Jaromir Tecl, Chotebor; Zdenek Matejka, Bilek; Tomas Zvolanek, Chotebor, all of Czechoslovakia

[73] Assignee: Tenez A.S., Chotebor, Switzerland

[21] Appl. No.: 81,648

[22] Filed: Jun. 22, 1993

[30] Foreign Application Priority Data

Jul. 16, 1992 [DE] Fed. Rep. of Germany ..... 4223321

[51] Int. Cl.[5] ..... F28D 9/00

[52] U.S. Cl. ..... 165/167; 165/166

[58] Field of Search ..... 165/166, 167

[56] References Cited

U.S. PATENT DOCUMENTS

| | | | |
|---|---|---|---|
| 3,590,917 | 7/1971 | Huber | 165/167 X |
| 4,592,914 | 6/1986 | Beasley | 165/167 X |
| 4,723,601 | 2/1988 | Ohara et al. | 165/166 X |
| 5,125,453 | 6/1992 | Bertrand et al. | 165/166 X |
| 5,158,135 | 10/1992 | Nagasaka et al. | 165/166 X |

FOREIGN PATENT DOCUMENTS

| | | | |
|---|---|---|---|
| 1-33497 | 2/1989 | Japan | 165/167 |
| 91/13308 | 9/1991 | PCT Int'l Appl. | 165/167 |
| 2126703A | 3/1984 | United Kingdom . | |
| 2167175A | 5/1986 | United Kingdom . | |

*Primary Examiner*—Stephen M. Hepperle

*Attorney, Agent, or Firm*—Frishauf, Holtz, Goodman & Woodward

[57] ABSTRACT

A stacked-plate heat exchanger. The plates are welded together alternately along lateral ridges and flanges formed around the periphery of the plates. The plates are also welded along the circumference of intake-and-outlet openings.

14 Claims, 4 Drawing Sheets

STACKED-PLATE HEAT EXCHANGER

BACKGROUND OF THE INVENTION

The present invention concerns a stacked-plate heat exchanger. Several corrugated and essentially rectangular plates are stacked and welded together to be sealed off from the environment. There are hollow spaces between the plates, and intake-and-outlet openings at the corners. Alternating spaces are occupied by one of two fluids. The fluids exchange heat.

Welded-stack heat exchangers are better than those that can be disassembled because the latter require resilient seals between the plates formed of, for example, an elastomeric material. Such seals can leak when they break down due to the presence of corrosive fluids or exposure to high temperatures and pressure, for example, and then they must be replaced. Welded-stack exchangers can be operated at higher temperatures and pressures and with more corrosive fluids because they have no elastomeric seals.

One type of welded-stack heat exchanger is known from GB Patent Application Nos. 2 126 703 and 2 167 175. The edges of adjacent plates are welded to strips of metal. The strips act as both spacers and seals. Each strip is welded to one plate such as to admit one particular fluid and the adjacent plate is positioned and welded to the same strip. The latter weld must always be welded through the upper plate. To prevent damage to the previous weld, each strip must be offset from the strip in the previous fluid space.

This requirement makes such an exchanger expensive to manufacture.

SUMMARY OF THE INVENTION

An object of the present invention is to provide a welded-stacked heat exchanger that is less complicated and cheaper to manufacture.

This object is attained in accordance with one aspect of the invention as will now be described. The periphery of the plates is provided with a lateral ridge and a lateral flange. The lateral ridge surrounds the plate peripherally, and its surface lies in a plane defined by the crests of the undulations on one side of the midplane of the corrugated plate. The lateral flange surrounds the lateral ridge, and its surface lies in a plane defined by the crests on the other side of the midplane. The intake-and-outlet openings provided in each plate for one of the fluids are surrounded by annular ridges in substantially the same plane as the lateral ridge. The outlet-and-intake openings in each plate provided for the other fluid are surrounded by annular ridges in substantially the same plane as the lateral flange. Adjacent plates are welded together along the lateral ridges and along the annular ridges, or cylindrical flanges adjacent thereto, to produce a subassembly. Adjacent subassemblies are then welded along the adjacent lateral flanges and along the annular ridges, or their adjacent cylindrical flanges.

With the above-described arrangement, it is unnecessary to use separate elastomeric sealing strips. All that is necessary is to weld the adjacent edges of the plates together. The annular ridges, and the cylindrical flanges if any, at the inlet-and-outlet openings allow the welding (which is needed to keep the two fluids separated) to be carried out along adjacent surfaces of the plates without the need for special measures.

An advantage of one disclosed embodiment of the invention is that all the plates can be stamped out identically, so that only one die is needed for the entire heat exchanger. Subassemblies, or plate packages, can be created just by rotating one of the plates 180° in relation to the other, so that they can be paired back to back.

Circulation can be particularly improved if the annular ridges on one side of the longitudinal axis of the plate face away from annular ridges on the other side. With a resulting arrangement, the fluids flowing in the heat exchanger will flow mainly toward each other in the alternating spaces. It is of course also possible within the scope of the invention for the orientation of the annular ridges to be related to the transverse axis of the plate.

It is in any event recommended for both the lateral flanges and the annular ridges to be shaped to ensure tight and reliable welding.

The annular ridges in one particular embodiment of the invention have cylindrical flanges extending perpendicularly to the midplane, and alternating ones of such plates have cylindrical flanges which extend such that, for a pair of plates that are combined into a subassembly, their cylindrical flanges fit together. The plates in one subassembly accordingly need not be welded from inside a hole in the plate but from the surface because the edges to be welded together have been rendered more visible and accessible. Welding is accordingly facilitated by making it easier and more reliable.

It is particularly advantageous for the respective cylindrical flanges that fit together on two plates to differ in length so that their free edges will be adjacent once the subassemblies have been assembled. This measure further facilitates the welding.

Lateral flanges on a pair of plates are welded together to form a subassembly. These lateral flanges are attached to the plate by a spacer which is perpendicular to the midplane. The edges will accordingly all be directly aligned, and the individual plates will be compact.

The lateral flanges can be left out in accordance with another version of the invention, and adjacent subassemblies can be attached by inserting U-shaped bars between them with their sides abutting against the facing surfaces of the lateral ridges and welded tight. The components of the bars can be previously assembled into a unitary body or added separately.

BRIEF DESCRIPTION OF THE DRAWINGS

Further characteristics and details of the invention will be evident from the description provided below taken together with the following drawings.

DETAILED DESCRIPTION OF THE INVENTION

Figure 1:
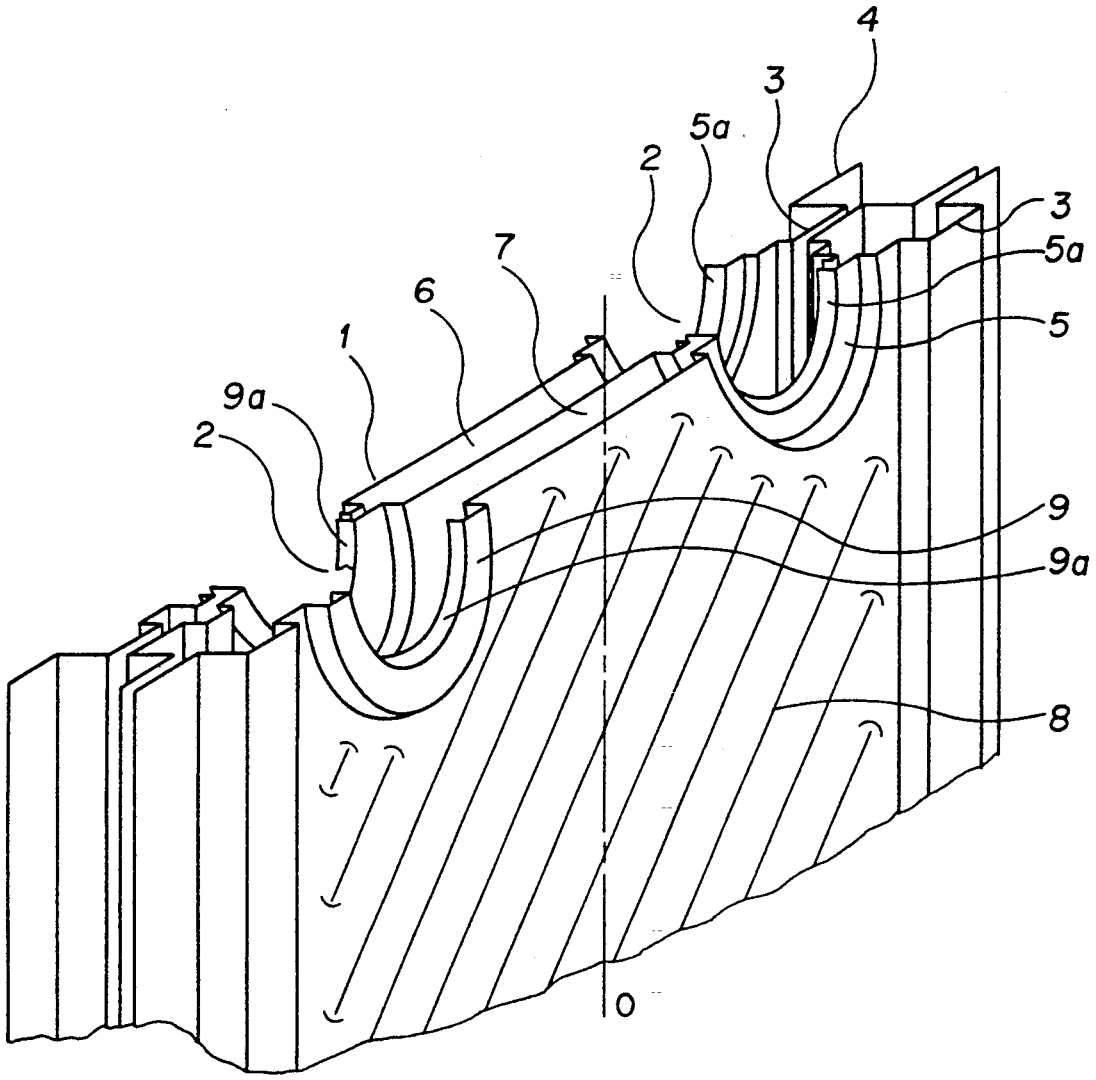
FIG. 1 is a perspective view of three plates in the first embodiment cut through the vicinity of the holes at the top.

Approximately rectangular plates 1 in each embodiment of the heat exchanger have an opening 2 at each corner that can be either an intake or an outlet for fluids that exchange heat.

The area of the plate bounded by openings 2 is corrugated with a wavy surface having undulations 8 to promote turbulence which improves the heat transfer characteristics. Each plate 1 has a main surface referred to herein as the midplane, with crests of undulations 8 extending to either side of the midplane. The crests on each side of the midplane define a plane that is parallel to the midplane.

Figure 2:
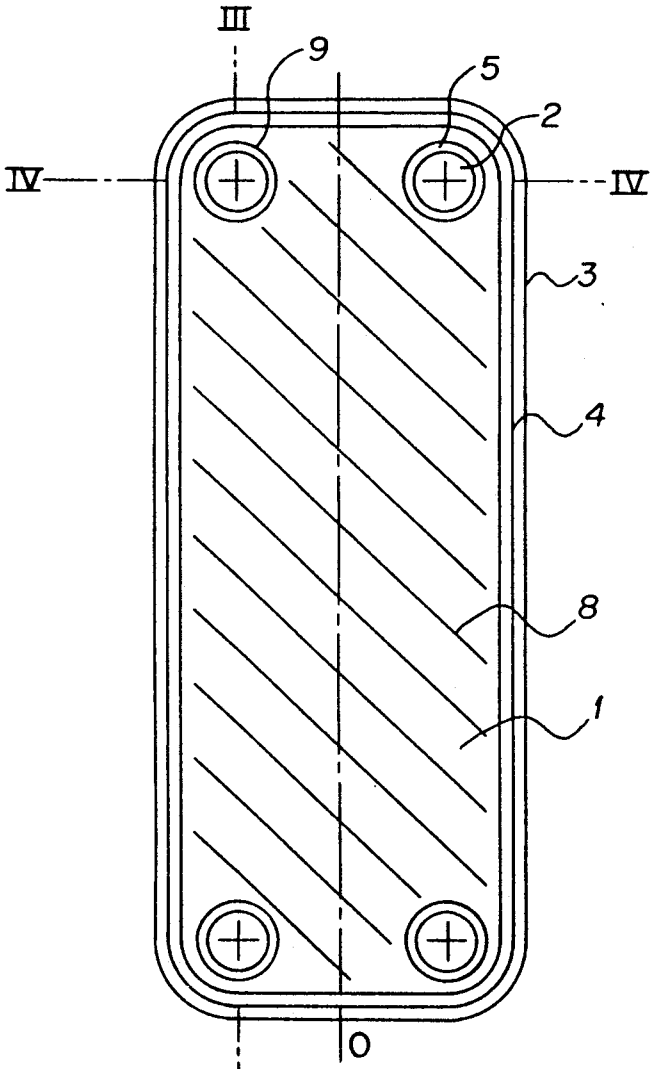
FIG. 2 is a top view of such a plate.
Figure 5:
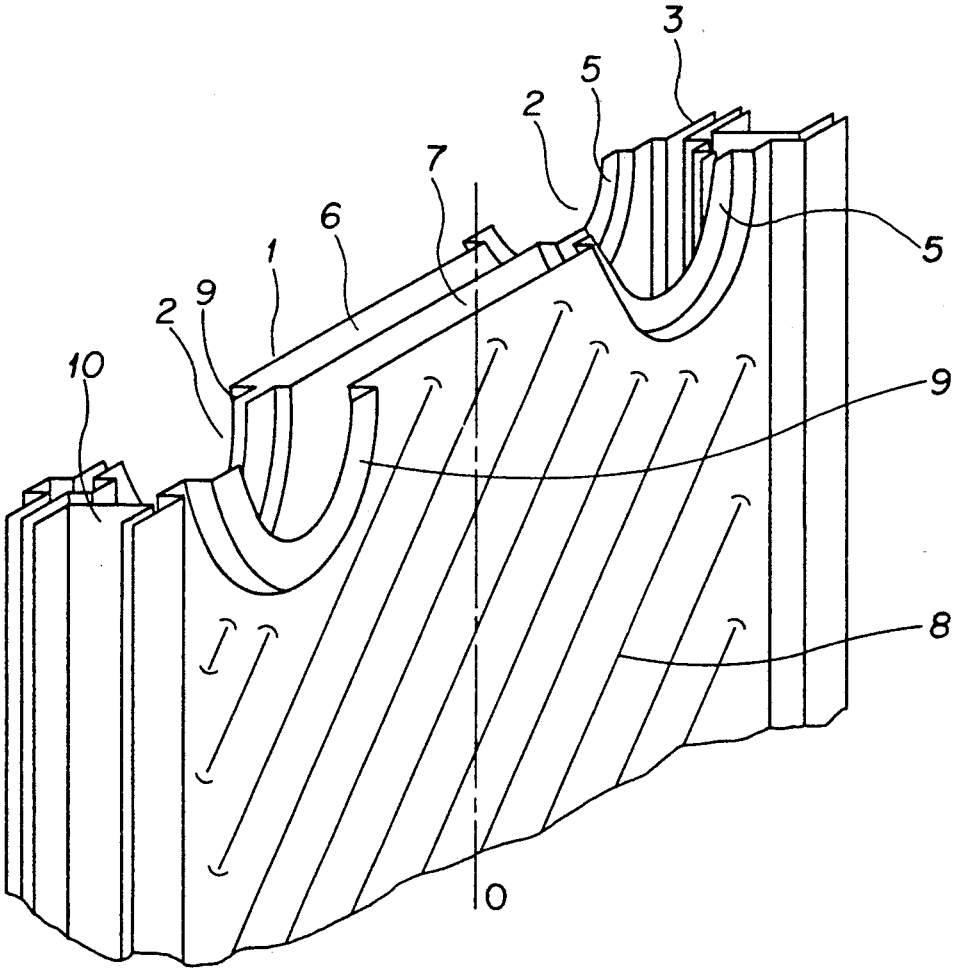

At the periphery of plates 1 is a lateral flange 4, and just inside it is lateral ridge 3 (see FIG. 2). These are formed as follows. Starting from the circumference of an opening 2 at a portion closest to the periphery of the plate and proceeding toward the periphery, the plate is bent perpendicular to the midplane, bends at a right angle so as to be parallel to the midplane, is bent back toward the midplane and extends past it, and then bent once more to be parallel to the midplane again, thus forming ridge 3 surrounded by flange 4. Ridge 3 lies in the plane defined by the crests of undulations 8 on one side of the midplane.

Openings 2 are provided with rims which include annular ridges. Starting at the circumference of an opening 2 and proceeding toward its center, the plate is bent perpendicular to the midplane and then bent again so as to be parallel to the midplane to form a ridge that lies in the plane of the crests of undulations 8. Two such annular ridges 9 are on the same side of the midplane as lateral ridge 3, and two such annular ridges 5 are on the same side of the midplane as flange 4.

Only the bottom halves of the upper openings 2 are visible in the three plates illustrated in FIG. 1. The annular ridges 9 and lateral ridge 3 on the forward and rear plates jut forward (in terms of the depicted orientation in the figure), and annular ridges 5 and flange 4 jut backward. The direction of these structures are reversed on the middle plate.

The foregoing features are common to all of the disclosed embodiments of the invention.

In the first embodiment illustrated in FIGS. 1 through 4, the inner edges of the annular ridges 5 and 9 are provided with cylindrical flanges 5*a* and 9*a*, respectively. These flanges are formed by bending the plate at a right angle to be perpendicular to the midplane. Thus, annular ridges 5 terminate in cylindrical flanges 5*a*, and annular ridges 9 terminate in cylindrical flanges 9*a*.

The procedure of creating a welded stack will now be specified.

Figure 4:
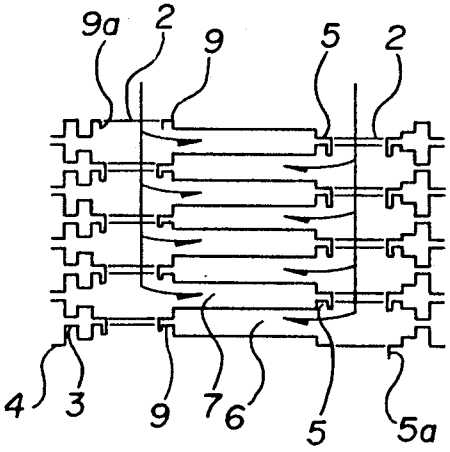
FIG. 4 is a cross-sectional view of the stack taken along line IV—IV in FIG. 2, and FIGS. 5 through 8 are views of plates of another embodiment respectively corresponding to FIGS. 1 to 4.
Figure 3:
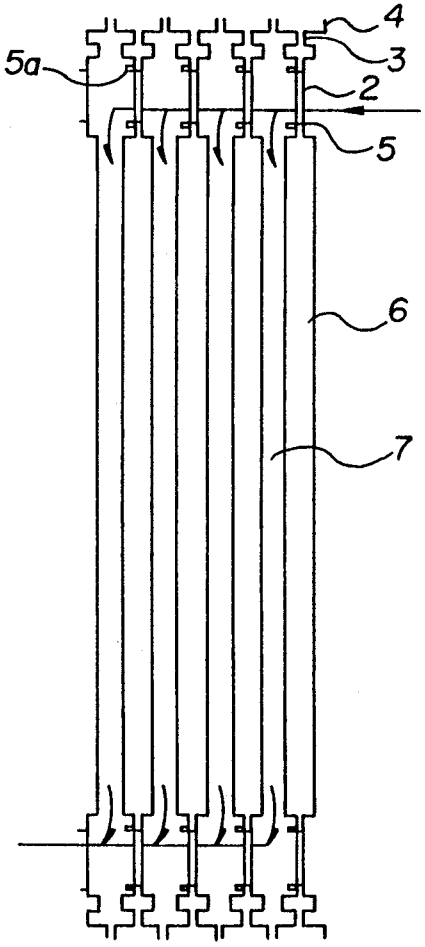
FIG. 3 is a cross-sectional view of a stack of such plates taken along line III—III in FIG. 2.

Two plates 1 are positioned against each other so that the lateral ridge 3 on one plate will abut against the lateral ridge 3 on the other. The annular ridges 9 on one plate will thus abut against the annular ridges 9 on the other. This is because ridges 3 and 9 of a plate lie in the same plane. The cylindrical flanges 9*a* of one plate fit inside the cylindrical flanges 9*a* on the other plate, with their free edges being adjacent to each other. This arrangement of the free edges facilitates making a tight weld. Ridges 3 are welded to each other, and cylindrical flanges 9*a* are welded to each other. The result is the subassembly having an interior space 6 as illustrated in FIGS. 1, 3, and 4. Openings 2 which are surrounded by ridges 9*a* that have been welded to each other do not allow access to interior space, or duct, 6 of this subassembly.

Another plate 1, such as the forward plate in FIG. 1 for example, is positioned against the subassembly oriented like the rear plate and with its lateral flange 4 abutting against the facing lateral flange 4 of the middle plate, and its cylindrical flanges 5*a* being inside the cylindrical flanges 5*a* on the middle plate. The forward and middle plates are welded to each other along the outer edges of the lateral flanges 4, and the free edges of the cylindrical flanges 5*a* are welded to each other so as to produce interior space, or duct, 7. The above-described procedure is repeated until a welded stack of the desired dimension, as illustrated in FIGS. 3 and 4 for instance, is attained.

It is also possible to produce a number of the above-described subassemblies of two plates by first welding the lateral ridges 3 and cylindrical flanges 9*a* on each pair of plates together, and then welding the subassemblies together along lateral flanges 4 and cylindrical flanges 5*a*.

It is just as possible to weld the plates together along cylindrical flanges 5*a* and 9*a* and lateral ridges 3 first and then to weld sets of two plates together along lateral flanges 4 only once the whole stack has been assembled.

Figure 8:
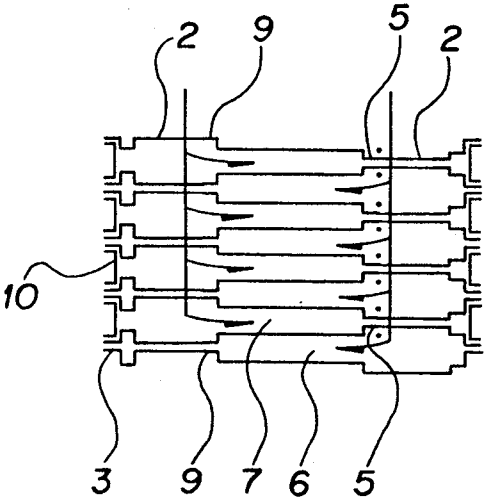
Figure 7:
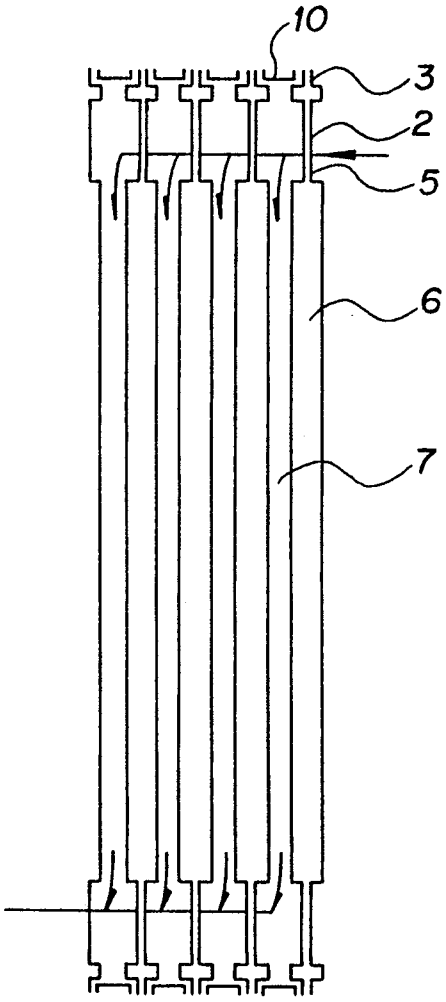
Figure 6:
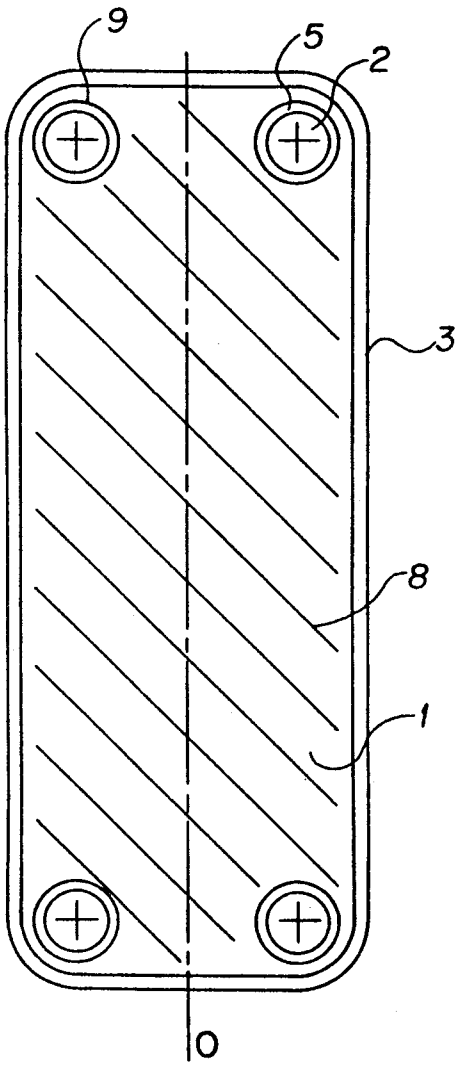

A second embodiment of the invention is arrived at by utilizing the plates 1 of the first embodiment, but without cylindrical flanges 5*a* and 9*a*. These modified plates are welded to each other at the circumference of openings 2. More specifically, the edges of the abutting annular ridges 5 are welded to each other, as are the abutting annular ridges 9 welded to each other. FIG. 8 shows such a structure at the periphery of openings 2. Even though FIG. 8 describes another embodiment, it serves to illustrate the salient, just-discussed aspect of this second embodiment.

The plates of a third embodiment, illustrated in FIGS. 5 through 8, lack a lateral flange 4 and the spacer with which it was connected to the plate. The periphery of these plates has only a lateral ridge 3. The plates are connected to each other by U-shaped bars 10. Bars 10 fit snugly into the gaps between the lateral ridges 3 of adjacent plate subassemblies, and the sides of bars 10 can readily be welded to the ridges 3.

It is unnecessary to weld the plates in this embodiment together individually. One advantage of the third embodiment is that the plates 1 and U-shaped bars 10 can be stacked together, and the pairs of plates that constitute the subassemblies and the bars 10 between them are then all welded together at the same time.

The most practical approach is to assemble the stack by positioning one plate against a matching plate with ridges 5 abutting against one another, welding ridges 5 together at both openings 2, adding a U-shaped bar 10, adding a third plate with its ridges 9 abutting those of the adjacent plate, and welding ridges 9 together. The procedure is continued by adding on a fourth plate so that its ridges 5 abut those of the adjacent plate, etc. The edges of the lateral ridges 3 and bars 10 are welded once the total stack has been welded together at the openings 2.

To arrive at a fourth embodiment, it is possible to provide cylindrical flanges 5*a* and 9*a* on the plates of the third embodiment, as was done for the first embodiment, to fit flanges 5*a* one within the other, and to fit flanges 9*a* one within the other. The welding for this portion of the plates is carried out in the same manner as described above in connection with the first embodiment.

Although the third embodiment is slightly more difficult to weld, it has the advantage that the total heat exchanger can be 20 assembled from identical plates, whereas the fourth embodiment requires slightly different plates because some of the cylindrical flanges must project forward and some backward and to different extents. This factor is of little significance in practice, however.

Various modifications to the embodiments of the present invention disclosed herein will be readily apparent to one with ordinary skill in the art. Such modifications are all intended to fall within the scope of the present invention as defined by the following claims.

We claim:

1. In a stacked-plate heat exchanger, wherein several corrugated and generally rectangular plates, each of which including a midplane having undulations formed therein, are stacked and welded together to be sealed off from the environment, and having hollow spaces formed between the plates and intake-and-outlet openings at the corners, with alternating spaces being occupied by one of two fluids which exchange heat, the improvement comprising:

a lateral flange (4) at the periphery of the plates and surrounding a lateral ridge (3), the lateral flange being parallel to the midplane and lying in a plane defined by crests of the undulations on one side of the midplane, and the lateral ridge being parallel to the midplane and lying in a plane defined by crests of the undulations on the other side of the midplane;

wherein the intake-and-outlet openings (2) provided in each plate for one of the fluids are surrounded by annular ridges (9) in substantially the same plane as the lateral ridge, and the outlet-and-intake openings for the other fluid are surrounded by annular ridges (5) in substantially the same plane as the lateral flange;

adjacent plates being welded together along the lateral ridges and along the annular ridges, or cylindrical flanges (5*a*, 9*a*) adjacent thereto, to produce a subassembly, and adjacent subassemblies being welded along abutting lateral flanges and along abutting annular ridges, or their adjacent cylindrical flanges.

2. A heat exchanger as in claim 1, wherein the plates are identical, and one is rotated 180° in relation to the other.

3. A heat exchanger as in claim 1, wherein said annular ridges (5) on one side of a longitudinal axis of the plate face in one direction and said annular ridges (9) on the other side of the longitudinal axis face in the opposite direction.

4. A heat exchanger as in claim 1, wherein said lateral ridges (3) and flanges (4) on each plate are flat.

5. A heat exchanger as in claim 1, wherein said annular ridges (5, 9) around the openings (2) are flat.

6. A heat exchanger as in claim 1, wherein said cylindrical flanges (5*a*, 9*a*) are approximately perpendicular to the annular ridges (5, 9), and the plates in one subassembly have cylindrical flanges that fit one inside the other.

7. A heat exchanger as in claim 6, wherein cylindrical flanges on the plate at the rear of a subassembly in relation to the cylindrical flanges are long enough so that the free edges of the cylindrical flanges will be adjacent to each other once the subassembly has been assembled.

8. A heat exchanger as in claim 7, wherein the plates are identical except that the cylindrical flanges on some extend opposite to the cylindrical flanges on the others.

9. A heat exchanger as in claim 6, wherein the plates are identical except that the cylindrical flanges on some extend opposite to the cylindrical flanges on the others.

10. A heat exchanger as in claim 1, wherein said lateral ridges (3) and said lateral flanges (4) are attached together by a spacer that extends along them perpendicular to the midplanes of the plates.

11. A heat exchanger as in claim 1, wherein the plates lack a lateral flange (4), and adjacent subassemblies are welded together by way of U-shaped bars (10) extending along and between them with their sides against and welded tight to respective facing surfaces of lateral ridges (3).

12. A heat exchanger as in claim 11, wherein said bars (10) are made of a unitary structure.

13. A heat exchanger as in claim 11, wherein the welds along the cylindrical flanges (5*a*, 9*a*), the lateral ridges (3), the lateral flanges (4), and said bars (10) are edge welds.

14. A heat exchanger as in claim 11, wherein the welds along the cylindrical flanges (5*a*, 9*a*), the lateral ridges (3), the lateral flanges (4), and said bars (10) are edge welds.

* * * * *